US005569029A

United States Patent [19]

Pöschl

[11] Patent Number: 5,569,029

[45] Date of Patent: Oct. 29, 1996

[54] BURNER

[75] Inventor: Günter Pöschl, Schwaikheim, Germany

[73] Assignee: PPV Verwaltungs AG, Zürich, Switzerland

[21] Appl. No.: 335,749

[22] PCT Filed: May 12, 1993

[86] PCT No.: PCT/EP93/01183

§ 371 Date: Nov. 14, 1994

§ 102(e) Date: Nov. 14, 1994

[87] PCT Pub. No.: WO93/23704

PCT Pub. Date: Nov. 25, 1993

[30] Foreign Application Priority Data

May 13, 1992 [DE] Germany ..... 42 15 763.3

[51] Int. Cl.[6] ..... F23L 9/00

[52] U.S. Cl. ..... 431/116; 431/188; 431/284

[58] Field of Search ..... 431/115, 116, 431/284, 285, 278, 9, 10, 187, 188, 350, 354

[56] References Cited

U.S. PATENT DOCUMENTS

| | | | |
|---|---|---|---|
| 2,857,961 | 10/1958 | Brown, III et al. | 431/116 |
| 2,973,808 | 3/1961 | Fox, Jr. | 431/116 |
| 3,869,244 | 3/1975 | Von Linde et al. | 431/116 |
| 3,980,233 | 9/1976 | Simmons et al. . | |
| 4,130,388 | 12/1978 | Flanagan | 431/116 |
| 4,979,894 | 12/1990 | Oppenberg | 431/116 |

FOREIGN PATENT DOCUMENTS

| | | |
|---|---|---|
| 286569 | 10/1988 | European Pat. Off. . |
| 1111865 | 3/1956 | France . |
| 2544361 | 4/1976 | Germany . |
| 2843002 | 4/1980 | Germany . |
| 3017034 | 12/1980 | Germany . |
| 4020237 | 1/1992 | Germany . |

OTHER PUBLICATIONS

Article entitled "Technische Druckschrift Low $NO_x$", published in Technische Dokumentation SAACKE, Mar. 1990, pp. 3–19.

*Primary Examiner*—James C. Yeung
*Attorney, Agent, or Firm*—William H. Eilberg

[57] ABSTRACT

A burner with a burner head (B) and a flame tube (F) is provided, with the burner head (B) having a concentric outlet arrangement of air and fuel feed nozzles. Following this a mixture of low-nitrogen air and fuel is produced, which is ignited in a chamber (11) in the interior of a hollow body (20). Hard-to-burn, noncombusted gas compounds flow upon exiting from the hollow body (20) along the exterior surface thereof back into the region before the hollow body (20) and flow again together with low-nitrogen air into the chamber (11) for combustion. This additional combustion increases the energy yield of the fuel and reduces the quantity of pollutants in the exhaust.

10 Claims, 3 Drawing Sheets

BURNER

TECHNICAL FIELD

This invention refers to a burner having a means for recirculation of combustion products from a flame tube back to a burner head.

BACKGROUND ART

To increase the efficiency of combustion systems and at the same time to reduce the emission of pollutants from gas turbine engines and furnaces, various improvements for burners have been proposed in the past. Moreover, legal requirements on maximum emission limits have gone into effect which must be met by the combustion systems. Aside from other combustion products, hydrocarbons and nitrogen oxides (NOx) are responsible for air pollution.

Acting as the nitrogen sources in this connection are, on the one hand, combustion air in the form of ordinary ambient air with its natural nitrogen content, and on the other hand, fuel, containing organically bonded nitrogen. In the combustion itself, the formation of nitrogen oxides depends heavily, among other things, on the length of time spent by the molecular nitrogen in the flame region. The shorter the time spent, the fewer the nitrogen oxides formed. Reducing the length of time, however, for instance by higher air or fuel flow rates, results in more noncombusted fluid compounds appearing in the emissions of the burner, causing a reduction in its efficiency.

The formation of carbon monoxide goes hand in hand with the formation of soot. Carbon monoxide has a high thermic value, which is thus lost for purposes of usable combustion.

Furthermore, the formation of nitrogen oxide is dependent on the flame temperature and increases with a rise in flame temperature. On the other hand, an increased flame temperature is desired to obtain a better fuel energy yield.

In a known burner for an airplane jet engine (DE-OS 30 17 034), in order to achieve both low emission of pollutants with fewer nitrogen oxides and increased efficiency, the burner head thereof is equipped with a concentric outlet arrangement in the form of several concentric, individually switchable outlet nozzles, with the fuel and air outlet nozzles alternating radially with each other starting from the center of the burner head. Depending on what single outlet nozzle is switched on, which depends in turn on the operating conditions, one (for idling) or two (for full load) combustion zones result. Hard-to-burn, noncombusted gas compounds are expelled with the emissions of this known burner and thus substantially lower the energy yield of the fuel.

Aside from their use in engines, burners are also used in furnaces. Here as well, various past improvements have been able to contribute to saving energy and reducing the emission of pollutants. One known method of reducing pollutants is that of external smoke gas recirculation. Ordinarily, in this method the smoke gas developed during combustion is returned to the combustion zone via external recirculation conduits partly with additional blowers. Unfortunately, this is accompanied by a lowering of the flame temperature, which decreases the nitrogen oxide formation.

Various methods of smoke gas recirculation are proposed in the publication "Technische Dokumentation Saacke," 1st edition 3/1990, of Saacke GmbH.

In the same publication an internal smoke gas recirculation is also described. Smoke gas herein is returned from the region after the flame end to the flame root by suitable means built into a combustion chamber, in the form of a pipe spaced apart from the outer wall of the combustion chamber. To be sure, with this internal smoke gas recirculation the emission of pollutants is also reduced by impeding the formation of nitrogen oxide; however, in this case as well a lowering of the flame temperature must also be tolerated, whereby the energy yield of the fuel is diminished.

A burner having a means for recirculation of combustion products is known from DE 40 20 237 A1. This known burner is specially designed in such a way that particularly the proportion of CO in the exhaust fumes is reduced. For this purpose, combustion air is fed to the marginal zone of the combustible gases, in order to attain a more complete combustion of the fuel in the flame tube and a corresponding reduction in the CO values. To be sure, the proportion of nitrogen oxides is possibly also reduced by this injection of air; however, in any case the combustion temperature is lowered, something which—as in the other known burners described above—entails the disadvantage that the fuel energy yield is thereby lowered. The return of combustible gases from the flame tube via the recirculation device into a mixing tube forming the chamber located in the outlet housing cannot effect an increase in the flame temperature, as the combustion zone does not extend into the mixing tube and the apertures through which combustion air is fed to the marginal zone of the combustible gases are not located too close to the entry end of the recirculation device in order that no additional air can get into the backflowing gases.

DISCLOSURE OF INVENTION

The object of the invention is to embody a burner having a means for recirculation of combustion products from a flame tube back to a burner head, such that an increase in flame temperature and fuel energy yield, with a simultaneous lowering of the emission of pollutants is achieved.

In the burner according to the invention a mixture formation zone is located between the outlet arrangement and the chamber, with hard-to-burn, noncombusted gas compounds being returned to this zone through the recirculation device and with low-nitrogen air being fed in the zone to the hard-to-burn, noncombusted gas compounds. The resulting mixture flows into the adjacent chamber, is ignited therein, as is an air/fuel mixture flowing in at the radial center of the burner, and thereby provides for a better energy yield and for an increase in flame temperature. The combustion zone begins accordingly in the chamber in the burner head. Noncombusted hydrocarbons no longer appear, due to the high flame temperature.

When low-nitrogen air emerging from an outer air inlet nozzle is used, this air simultaneously acts as a protective sheath for the fuel stream against the ambient atmosphere. This ensures that no exterior air, which primarily contains nitrogen, can reach the combustion zone.

With the recirculation of hard-to-burn gas compounds into the mixture formation zone, the flame temperature is initially lowered somewhat, with the result that the flame root shifts further into the interior of the chamber. With the combustion of the hard-to-burn gas compounds the flame temperature again rises sharply, whereby the flame root shifts back towards the outlet arrangement. This procedure continually repeats itself, so that the flame root oscillates at a relatively high frequency. The advantage of this is that the mixing of the hard-to-burn, noncombusted gas compounds and the low-nitrogen air of the protective sheath in the mixture formation zone is encouraged, which in turn ensures the combustion of the hard-to-burn gas compounds. With increasing temperature this frequency becomes higher.

Thus, contrary to the known burners given above, the burner according to the invention provides for an increase in flame temperature and not a temperature reduction. Moreover, no smoke gas or combustible gas is recirculated, but rather hard-to-burn, noncombusted gas compounds. In the burner according to the invention, the recirculation itself already begins in the burner head, radially outside of the combustion zone, whereas a burner according to the technical documentation Saacke or according to the DE 40 20 237 A1 recirculates smoke gas or combustible gas from the combustion chamber.

In another embodiment of the invention, the chamber is formed by the interior space of a rotationally cylindrical hollow body located in an outlet housing of the burner head, the hollow body having an inflow and an outflow orifice, with air/fuel mixture and the mixture of low-nitrogen air and recirculated hard-to-burn, noncombusted gas compounds flowing through the hollow body. A uniform space between the hollow body and the outlet housing forms a return passage for the hard-to-burn, noncombusted gas compounds. The hard-to-burn, noncombusted gas compounds located downstream of the chamber in the outer region of the flame are sucked in accordance with the venturi principle back to the region before the chamber, where they mix with the low-nitrogen air from an outer air feed nozzle and flow into the chamber.

Furthermore, in the embodiment of the invention described above the hollow body is an elongated, substantially egg-shaped hollow body. This design of the hollow body results in a defined, controllable flame front or combustion zone. After the entry of the air/fuel mixture into the hollow body, the cross-sectional widening of the hollow body leads to a deliberate reduction of the rate of flow of the mixture. As soon as the speed of the inflowing mixture is sufficiently low, the gas can be ignited with a common ignition device. A positionally stable combustion zone with an oscillating flame root comes into being in the hollow body.

According to another embodiment of the invention, the supplied quantity of air and/or fuel is adjustable. This is attained with an adjustable air feed nozzle and/or fuel feed nozzle.

In another advantageous embodiment of the burner, a defined flow stall occurs at sharp annular edges of the air and fuel feed nozzles, whereby the fuel supplied is atomized.

The low-nitrogen air for the protective sheath of the fuel against the ambient atmosphere is introduced into the mixture formation zone in another embodiment of the invention through a plurality of small nozzle bores.

To improve the flow through the hollow body as well as the flow of the hard-to-burn, noncombusted gas compounds at its exterior, according to another feature the hollow body itself is designed in longitudinal section as a wing profile. This means that the wall thickness of the hollow body first increases in the direction of flow, to then gradually decrease again. Due to the high flame temperatures in the discharge region of the hollow body, the thickness of the hollow body wall should not be less than a certain minimum. For this reason, however, it is not quite possible for the wing profile of the hollow body to taper off to a point, which would be optimal from the standpoint of fluidics.

Due to the shape of the flame tube according to at the radial center of the burner, the flame completely hugs the flame tube after a certain distance from its exit from the chamber. This prevents the hard-to-burn, noncombusted gas compounds released downstream of the chamber between the flame and the flame tube from flowing out with the flame and not being recirculated by the venturi effect. Furthermore, the entry of the ambient atmosphere is prevented.

In another embodiment of the invention, the mixture in the chamber can be ignited in a simple manner and, furthermore, the electric charge arising from the plasma formation processes taking place in the chamber can be conducted to the outside. The electric energy gained by this can be used to run auxiliary aggregates.

An embodiment of the invention is described in detail below, with reference to the drawings.

BEST MODE OF CARRYING OUT THE INVENTION

Figure 1:
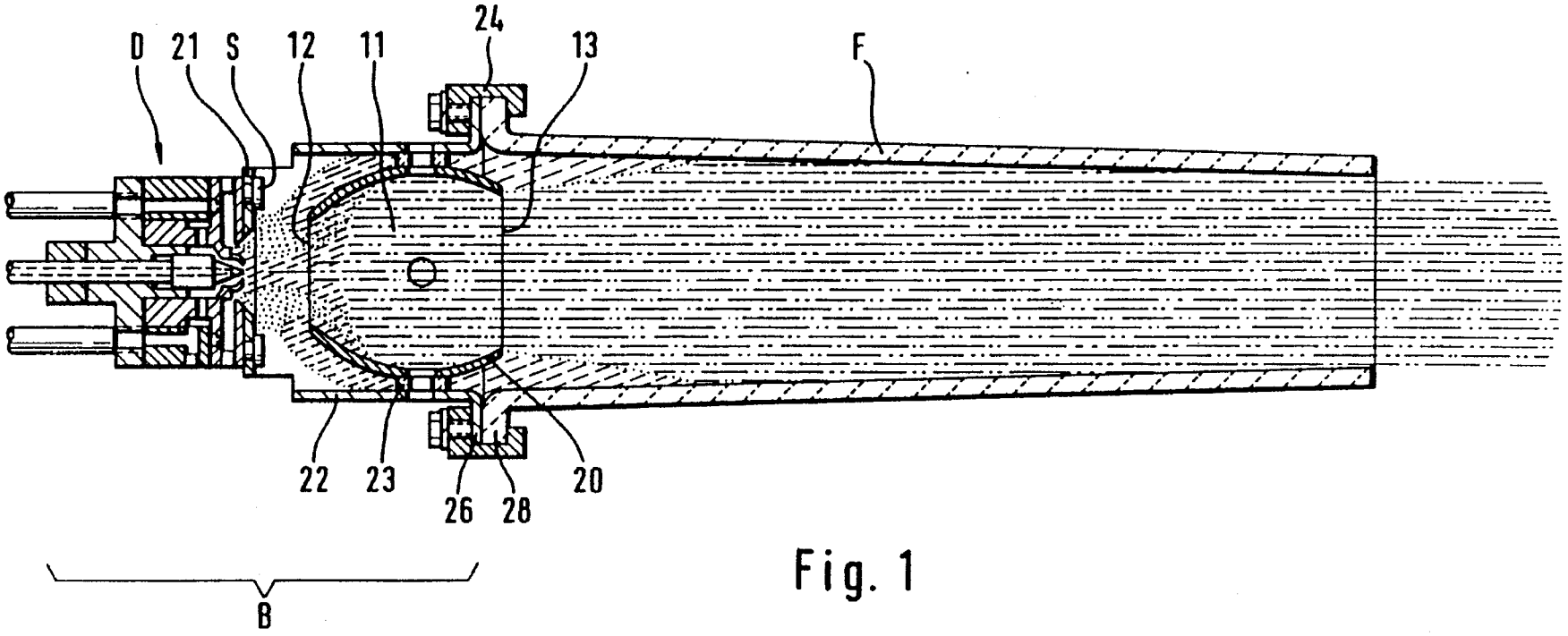
FIG. 1 shows a longitudinal section of a burner according to the invention, with a combustion zone and flow layers.

FIG. 1 shows a burner consisting of a burner head B and an adjoining flame tube F. The part of the burner head B shown on the left in FIG. 1 is described as nozzle connection D and has a concentric outlet arrangement described in greater detail below. The right-hand part of the burner head B forms an outlet housing 22 with a bottom 21 connected to the nozzle connection D via screws S. In the outlet housing 22 an elongated, substantially egg-shaped hollow body 20 is attached with spacers 23 to the housing at a uniform distance from its inner wall. Several insulating bodies of beryllium ceramic attached between the hollow body 20 and the outlet housing 22 serve as spacers. The interior space of the hollow body 20 forms a chamber 11. The hollow body 20 has an inflow orifice 12 facing the outlet arrangement and an outflow orifice 13 facing the flame tube F.

The outlet housing 22 is made of unhardened stainless steel and has a radial flange 26 at its end opposite the bottom 21. The flame tube F has a flange 28 at its end facing the outlet housing 22. The outlet housing 22 and the flame tube F are fixed together at their flanges 26, 28 by means of several clamps 24.

Figure 2:
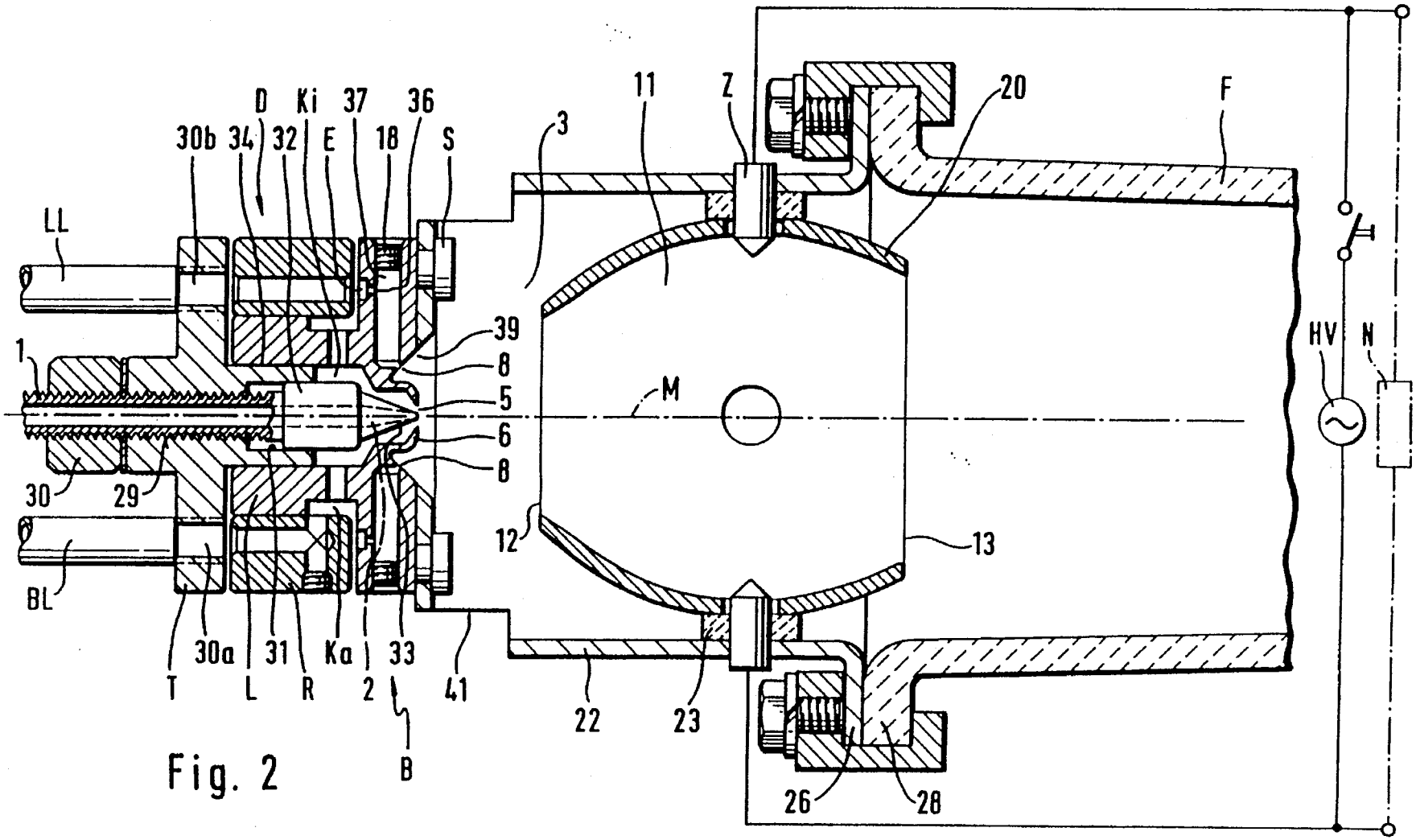
FIG. 2 shows a longitudinal section of a burner according to the invention, with a burner head and front flame tube region.

FIG. 2 shows an enlarged view of the burner head B with a portion of the flame tube F, consisting of silicon nitride ceramic, attached thereto. The nozzle connection D is made up of several lathed parts L, R and T of hardened stainless steel. To simplify viewing, copper seals provided between parts L, R and T are not shown.

The left-hand part T of the nozzle connection D is a nozzle guide part having a centrally located tapped bore 29 and one bore 30*a*, 30*b* each for attaching a fuel duct BL and an air duct LL, respectively. The tapped bore 29 extends from the back side of the nozzle guide part T facing away from the flame tube F to a likewise centrally located fitting bore 31 in the front part of the nozzle guide part. An air feed pipe 1 provided with a male thread is screwed into the tapped bore 29 of the nozzle guide part T from the side facing the flame tube F. The part of the air feed pipe 1 facing flame tube F is provided with a cylindrical fitting piece 32 adapted to the diameter of the fitting bore 31 of the nozzle guide part T and having a larger diameter than the tapped bore 29. By this means the air feed pipe 1 can center itself in the fitting bore 31. A tip 33 of the air feed pipe 1 contains an inner air feed nozzle 2 which is part of an injector. The exterior surface of the tip 33 of the air feed pipe 1 and likewise the inner surface of the air feed nozzle 2 taper off conically in the direction of flow of the supplied air in such a manner that a sharp annular edge is formed at the end of the tip 33. The air feed pipe 1 can be screwed more or less deeply into the nozzle guide part T. When the desired depth has been reached the air feed pipe 1 is fixed in place with a counternut 30.

Radially outside of the fitting bore 31 an outer cylindrical fitting surface 34 is formed on the nozzle guide part T, with a centered air guiding body designated as part L seated thereupon. The air guiding body L thus centered on the nozzle guide part T has several axial and radial bores further explained below, to conduct fuel and/or air.

A fuel chamber ring designated as part R is in turn seated radially outside of the air guiding body L and is likewise provided with radial and axial bores serving to conduct fuel and air.

The air guiding body L has on its external side a turned recess which, together with the fuel chamber ring R, forms an annular outer fuel chamber Ka. The outer fuel chamber Ka communicates via some of the radial bores in the air guiding body L with an annular inner fuel chamber Ki radially bounded by the air feed pipe 1 and the air guiding body L. For supplying fuel a portion of the axial bores of the fuel chamber ring R communicates via a portion of its radial bores with the outer fuel chamber Ka. At the front end of the tip 33 the cross section of the inner fuel chamber Ki narrows considerably since the air guiding body L has an annular wall 6 considerably bent inwardly at its adjacent end. The annular wall 6 tapers off at its end to form a sharp annular edge. This annular wall 6, together with the tip 33, forms a fuel feed nozzle 5 with an annular outflow cross section.

The air guiding body L further has an annular turned groove E in its face adjacent the fuel chamber ring R, this groove communicating with the air duct LL via a portion of the axial bores in the fuel chamber ring R. Four small axial bores 36 connect the groove E with four large radial bores 37 closed to the outside by one headless screw 18 each. The radial bores 37 open via an outer air feed nozzle 8 comprised of four small nozzle bores 0.5 mm in diameter, into a space in the outlet housing 22 formed between the nozzle connection D and the hollow body 20. This space is called mixture formation zone 3. The nozzle bores of the outer air feed nozzle 8 are each directed at a slant towards a middle axis M of the outlet housing 22 as viewed from the four radial bores 37, so that the axes of these nozzle bores intersect at one point on the middle axis M of the outlet housing 22 in front of the inner air feed nozzle 2. The air guiding body L has a funnel-shaped, deep turned recess 39 on its end facing the flame tube F, radially outside of its annular wall 6, with the annular wall 6 protruding from this recess. Seen in cross section, the outer surface of the funnel-shaped turned recess 39 is approximately at right angles to the nozzle bores of the outer air feed nozzle 8.

The nozzle guide part T, the air guiding body L, the fuel chamber ring R and the outlet housing 22 are clamped together with screws S. Through bores for this are provided in the fuel chamber ring R and tapped bores are provided in the nozzle guide part T to receive the screws S. The outlet housing 22 is provided with apertures 41 in the region of the heads of the screws S.

As already explained, the hollow body 20 is mounted inside the outlet housing 22 by means of the spacers 23 at a uniform distance from the inner wall of the outlet housing 22. The hollow body 20 has several diametrically opposed radial bores which, together with bores in the spacers 23 and bores in the outlet housing 22, form diametrically opposed through holes, of which only two each are visible in FIG. 2. Firing electrodes Z, connected to a high voltage source HV, extend through these holes into the interior of the hollow body 20, hence into chamber 11. In addition, the firing electrodes Z are connected to auxiliary aggregates N.

Figure 3:
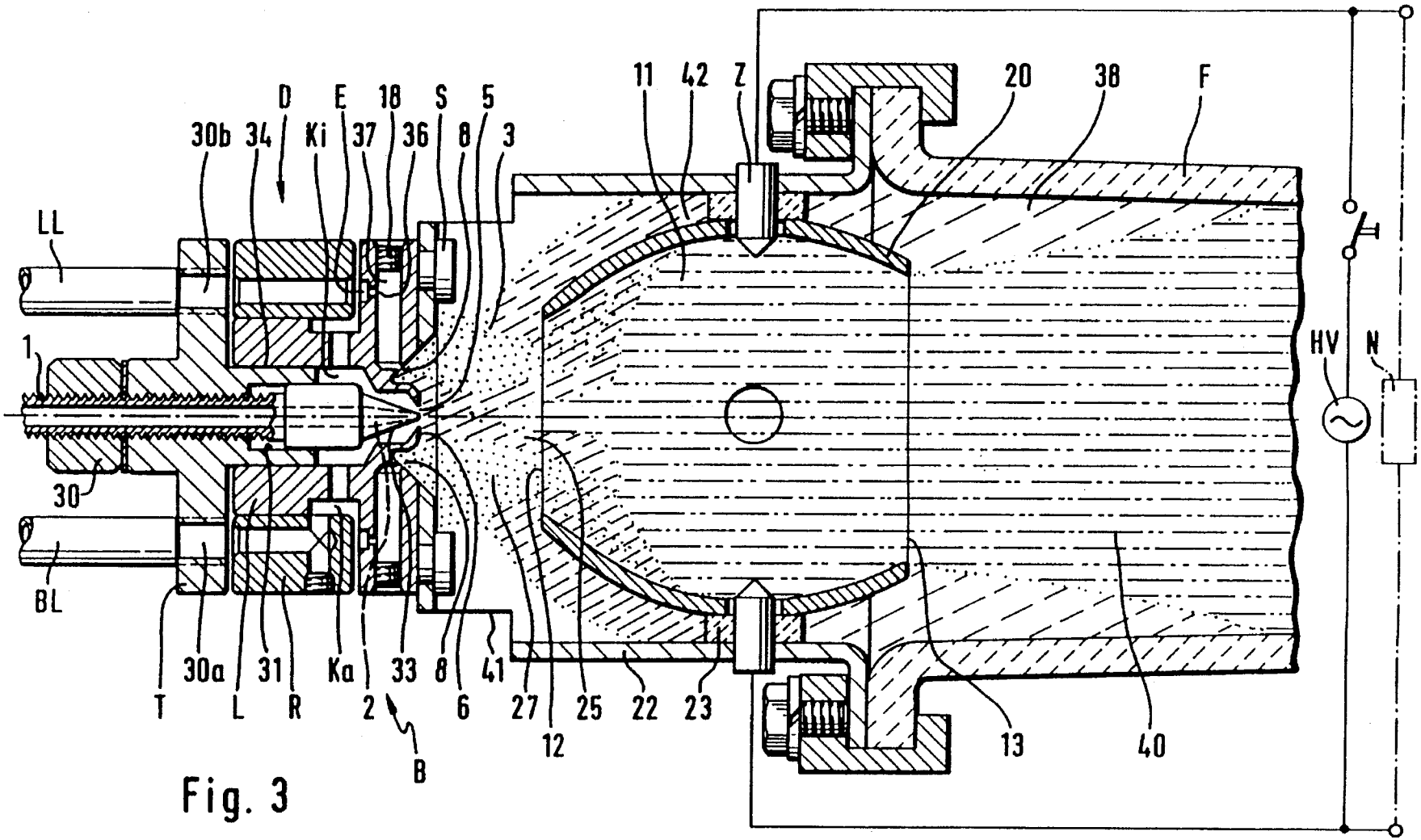
FIG. 3 shows an enlarged view of the burner head according to FIG. 1.

The mode of operation of the burner is explained below with reference to FIG. 3.

Low-nitrogen air from a central air source not shown is introduced into the nozzle connection D via the air duct LL on the one hand and the air feed pipe 1 on the other. The introduction of the fuel takes place via the fuel duct BL.

A portion of the low-nitrogen air flows through the air feed pipe 1 centrally located in the nozzle connection D to the inner air feed nozzle 2 and flows accelerated through the inner air feed nozzle 2 as a centrally located air jet into the outlet housing 22. Fuel is conducted via the fuel duct BL into the nozzle connection D and therein through several radial and axial bores through the outer and inner fuel chambers Ka and Ki, respectively, to the annular fuel feed nozzle 5. Since the inner air feed nozzle 2 and the fuel feed nozzle 5 are designed to form an injector, the fuel is swept along out of the fuel feed nozzle 5 by the centrally located air jet and flows together with the same into the outlet housing 22. As the adjacent ends of the air feed nozzle 2 and the annular wall 6 are provided as sharp annular edges, a defined flow stall occurs at the edges, whereby the supplied fuel is very thoroughly atomized. This atomized fuel mixes completely with the centrally located air jet in the mixture formation zone 3 and flows as an easily ignitable air/fuel mixture into the elongated, substantially egg-shaped hollow body 20.

The electrodes Z projecting into the hollow body 20 are connected for ignition to the high voltage source HV and produce an arc which ignites the air/fuel mixture. A combustion zone, also called flame front 40, arises, beginning in the chamber 11 still in the burner head B itself and having a flame root which is formed in the chamber 11 near the inflow orifice 12. Even before leaving the chamber 11, the flame front 40 takes up the entire cross section of the chamber. At its exit from the chamber 11 the flame front 40 reaches its highest temperature. Due to the extreme thermal load on the hollow body 20, it is made of tungsten. Upon leaving the hollow body 20, the flame front 40 does not completely hug the flame tube F until after a certain distance from the outflow orifice 13 has been reached. The shade of the flame front 40 depends in particular on the type of fuel. The flame tube F is exactly adapted to the shape of the flame front 40, so that no intermediate space develops between flame tube F and flame front 40 through which hard-to-burn, noncombusted gas compounds could escape from the flame tube F or the ambient atmosphere could enter via the flame tube F.

At the exit of the flame front 40 from the hollow body 20, hard-to-burn, as yet noncombusted gas compounds are in the outer region of the flame front 40. These compounds are released in an exit space 38 when the flame front 40 exits from the hollow body 20. The exit space 38 is annular and forms the region between the exiting flame front 40 and the flame tube F in the area in which the flame front 40 has not yet completely hugged the flame tube F. The hard-to-burn, noncombusted gas compounds located in the exit space 38 are conveyed back towards the outlet arrangement in accordance with the venturi principle via an annular space 42 forming a recirculation device and bounded by the hollow body 20 and the outlet housing 22. This return is facilitated in that the longitudinal section of the hollow body 20 has a wing profile, causing the current to closely hug the hollow body 20 and avoid eddies.

Hard-to-burn gas compounds require much oxygen for their combustion. For this purpose, the hard-to-burn, noncombusted gas compounds returned to the mixture formation zone 3 are mixed with low-nitrogen air from the nozzle bores of the outer air feed nozzle 8, with the low-nitrogen air reaching the nozzle bores via the bores **30*b*, 36, the annular turned groove E and the bores 37 communicating therewith, located in the lathed parts of nozzle connection D. The turned groove E is necessary for equal pressure conditions to exist in all nozzle bores of the outer air feed nozzle 8. The cross section of the bores 36 and 37 is greater than that of the nozzle bores of the outer air feed nozzle 8 itself, so that banked-up pressure is always at hand. The nozzle bores 8 are directed inwardly at a slant towards the developing centrally flowing air/fuel mixture, resulting in an outer, conical air jet. The cross section of flow for the conical jet of low-nitrogen air tapers off until it hits the air/fuel mixture, whereupon, after a gas jet diffraction caused by hitting the air/fuel mixture, it then slightly expands conically and flows into the hollow body 20. This low-nitrogen air flowing around the air/fuel mixture acts as a protective sheath 25 against the ambient atmosphere, which has access via the apertures 41 and should be kept apart from the combustion due to its high nitrogen content. In addition to the protective sheath 25, however, an annular low-nitrogen air zone 27 is also formed radially outside of this protective sheath 25, this zone being formed by low-nitrogen air from the nozzle bores 8. The flow in the low-nitrogen air zone 27 is directed by the slanted nozzle bores 8 and the shape of the air guiding body L in the region after the nozzle bores 8 in such a way that the low-nitrogen air mixes with the recirculated hard-to-burn, noncombusted gas compounds in part while still in the mixture formation zone 3 and flows into the chamber 11 together with the same. The hard-to-burn, noncombusted gas compounds thus receive the oxygen required for their combustion via the low-nitrogen air. The mixing ratio of the hard-to-burn, noncombusted gas compounds flowing into the chamber 11 and the low-nitrogen air is such that they are ignited in the chamber 11, whereby the flame temperature is greatly increased. By this means the flame root shifts towards the outlet arrangement. This process of recirculation, mixing and ignition continually repeats itself, so that the flame root oscillates axially at a relatively high frequency. The result of this is that the burner produces a rumbling sound. This oscillation has the additional advantage that a pressure column produced in the mixture formation zone 3 likewise oscillates and aids in promoting the mixing of the hard-to-burn, noncombusted gas compounds with the low-nitrogen air and preventing the entry of the ambient atmosphere into the chamber 11**.

For the burner to function at its best it is necessary to precisely adjust the quantities of fuel supplied and of low-nitrogen air. The fuel quantity supplied is adjusted by screwing the air feed pipe 1 more or less deeply into the nozzle guide part T. As the tip 33 of the air feed pipe 1 simultaneously forms the inner wall of the annular fuel feed nozzle 5, the cross section of the fuel feed nozzle 5 is increased by screwing the air feed pipe 1 further into the nozzle guide part T and more fuel flows into the mixture formation zone 3. The adjustment of the supplied quantity of low-nitrogen air takes place via setting screws not shown, by means of which the cross sections of flow of the air duct LL and the air feed pipe 1 are more or less reduced.

The flame front 40 enters a combustion chamber (not shown) after the end of the flame tube F. Experiments have shown that the exhaust fumes released contain hardly any noncombusted hydrocarbons and only the slightest quantities of carbon monoxide and nitrogen oxides.

The structure of the burner permits operation both with mineral or organic fuels, and with combustible gases, particularly hydrocarbon gases.

In addition to the thermal gain by the combustion, electric energy can also be taken from the burner. The combustion in the chamber 11 leads to a plasma formation. The electric charge resulting from this can be drawn to the outside via the electrodes Z and used to supply energy to the auxiliary aggregates N. The electric energy gained in the combustion amounts to several hundred watts in a burner for normal furnaces. To enable the charge to be drawn off, the hollow body 20 is insulated against the outlet housing 22 as depicted above.

I claim:

1. In a burner including a burner head and a flame tube connected to the burner head, the burner head having at least one air feed nozzle and a fuel feed nozzle, the air feed nozzle and fuel feed nozzle being arranged concentrically, the burner including an outlet housing, the burner also including a chamber located within the outlet housing and an annular space located between said chamber and the outlet housing, the annular space comprising means for recirculating gas between the chamber and the outlet housing, the improvement wherein there is an inner air feed nozzle and at least one outer air feed nozzle, the fuel feed nozzle being located between the inner and outer air feed nozzles, all of said nozzles being arranged concentrically, wherein the chamber is spaced from the air feed and fuel feed nozzles sufficiently to define a combustion zone within the chamber, wherein the burner includes a mixture formation zone located between the chamber and the air feed and fuel feed nozzles, wherein the recirculating means comprises means for recirculating hard-to-burn noncombusted gas compounds to the mixture formation zone, wherein the inner air feed nozzle and the fuel feed nozzle together define an injector which comprises means for sweeping fuel out of the fuel feed nozzle and into the mixture formation zone, wherein the outer air feed nozzle comprises means for feeding low-nitrogen air into the burner, and wherein the outer air feed nozzle is directed inwardly, the outer air feed nozzle comprising means for mixing low-nitrogen air with the recirculating non-combusted gas compounds and for causing the low-nitrogen air and non-combusted gas compounds to flow into the chamber to be combusted, the outer air feed nozzle further comprising means for causing the low nitrogen air to envelop fuel introduced through the fuel feed nozzle, as a protective sheath against ambient air, prior to mixing with the non-combusted gas compounds.

2. The improvement of claim 1, wherein the chamber comprises the interior of an elongated, substantially egg-shaped, rotationally cylindrical hollow body located within the outlet housing, the hollow body having an inflow orifice facing the air feed and fuel feed nozzles and a diametrically opposite outlet orifice.

3. The improvement of claim 2, further comprising infinitely variable means for controlling a quantity of low-nitrogen air and/or of fuel, fed through the air feed nozzles and/or the fuel feed nozzle, respectively.

4. The improvement of claim 2, wherein the fuel feed nozzle comprises an annular gap having an inner boundary defined by an end of the inner air feed nozzle and an outer boundary defined by an annular wall bent at an angle towards the end of the inner air feed nozzle, wherein the annular wall has an end, and wherein the end of the inner air feed nozzle and the end of the annular wall comprise sharp annular edges.

5. The improvement of claim 2, wherein the outer air feed nozzle comprises a plurality of small nozzle bores, the bores comprising means for introducing the protective sheath as a substantially conical air jet into the mixture formation zone.

6. The improvement of claim 2, wherein the hollow body has a longitudinal cross-section having a shape of a wing profile.

7. The improvement of claim 1, wherein the flame tube comprises means for preventing entry of ambient air between the flame tube and a flame front formed within the flame tube during combustion.

8. The improvement of claim 1, wherein the hollow body is electrically insulated from the outlet housing, and wherein the burner further comprises electrodes inserted into the hollow body.

9. In a burner comprising a burner head and a flame tube connected to the burner head, the burner head having at least one air feed nozzle and a fuel feed nozzle, the air feed nozzle and fuel feed nozzle being arranged concentrically, the burner including an outlet housing, the burner also including a chamber located within the outlet housing and a first annular space located between said chamber and the outlet housing, the first annular space comprising means for recirculating gas between the chamber and the outlet housing, the improvement wherein there is an inner air feed nozzle and an outer air feed nozzle, the fuel feed nozzle being arranged between the inner and outer air feed nozzles, wherein the chamber is spaced from the air feed and fuel feed nozzles to define a mixture formation zone, wherein the chamber has a cross-sectional area which increases and then decreases, in a direction of gas flow through the burner, so as to define a second annular outlet space, the second annular outlet space being fluidly connected to the first annular space, wherein the inner air feed nozzle and the fuel feed nozzle together define an injector which comprises means for producing an air jet which carries fuel into the mixture formation zone, and wherein the outer air feed nozzle is directed inwardly, the outer air feed nozzle comprising means for mixing low-nitrogen air with recirculating gas, and for causing the low-nitrogen air and recirculating gas to flow into the chamber to be combusted, the outer air feed nozzle further comprising means for causing the low nitrogen air to envelop fuel introduced through the fuel feed nozzle, as a protective sheath against ambient air, prior to mixing with the recirculating gas, the outer air feed nozzle also comprising means for causing the low-nitrogen air to mix radially outwardly with the recirculating gas.

10. In a burner comprising a burner head, an outlet housing connected to the burner head, and a flame tube connected to the outlet housing, the outlet housing and the flame tube defining a common interior region, the burner comprising means for introducing air and fuel into the burner, the improvement comprising a hollow body, located within said interior region, the hollow body having a transverse cross-section which increases and then decreases in a direction towards the flame tube, the hollow body being spaced apart from the outlet housing, by a distance sufficient to permit recirculation of gas from the flame tube back towards the outlet housing, wherein the burner further comprises means for introducing low-nitrogen air into the burner.

* * * * *